US010800010B2

(12) United States Patent
Chen

(10) Patent No.: US 10,800,010 B2
(45) Date of Patent: Oct. 13, 2020

(54) BIASED PLIERS

(71) Applicant: JS Products, Inc., Las Vegas, NV (US)

(72) Inventor: Chungeng Chen, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 954 days.

(21) Appl. No.: 14/938,839

(22) Filed: Nov. 11, 2015

(65) Prior Publication Data

US 2016/0129561 A1 May 12, 2016

Related U.S. Application Data

(60) Provisional application No. 62/078,359, filed on Nov. 11, 2014.

(51) Int. Cl.
*B25B 7/08* (2006.01)

(52) U.S. Cl.
CPC ..... *B25B 7/08* (2013.01)

(58) Field of Classification Search
CPC .... B25B 7/08; B25B 7/18; B25B 7/00; B25B 7/02; B25B 7/10; B23P 15/00; B24B 3/60; Y10T 29/49934; Y10T 29/49908
See application file for complete search history.

(56) References Cited

U.S. PATENT DOCUMENTS 2,774,993 A * 12/1956 Hagen ..... B29C 49/52 156/86
3,600,979 A * 8/1971 Rozmus ..... B23P 15/00 29/505
8,209,865 B2 * 7/2012 Kelley ..... B23P 19/04 29/424

* cited by examiner

*Primary Examiner* — David B. Thomas
(74) *Attorney, Agent, or Firm* — Weide & Miller, Ltd.

(57) ABSTRACT

A tool and a method of manufacture of the tool are provided. The tool is prepared by the steps of providing a first tool half having a first jaw, providing a second tool half having a second jaw, inserting a temporary sleeve through an opening in the first tool half, the temporary sleeve having an opening configured to receive an end of a biased member that extends axially, aligning the end of the biased member with the opening in the first tool half, disposing the biased member within a cavity formed by the first tool half and the second tool half, and removing the temporary sleeve.

20 Claims, 14 Drawing Sheets

BIASED PLIERS

CROSS-REFERENCES TO RELATED APPLICATIONS

This application claims the benefit of and claims priority to U.S. Provisional Patent Application No. 62/078,359 entitled "BIASED PLIERS" and filed on Nov. 11, 2014 for Chungeng Chen, which is incorporated herein by reference.

TECHNICAL FIELD

The present invention relates to pliers and, more particularly, pliers which are biased into a particular position.

BACKGROUND

A wide variety of configurations of pliers are well known. Generally, pliers have two plier halves which are pivotally connected to one another. Each plier half has a handle portion and a jaw portion. A user may grip the handle portions of the two halves and manually move the handle portions so as to open or close the jaw portion of the pliers.

One problem with these types of pliers is that in some instances it is difficult for the user to move the plier halves. For example, in a tight space a user may only be able to grip the pliers with one hand, making movement of the pliers, especially spreading of the handle portions apart so as to open the jaw portion of the pliers, very difficult.

Some attempts have been made at addressing this problem, but these attempts have resulted in pliers which are in some cases oversized or undesirable in configuration, which are complex in configuration and thus expensive to manufacture, or which have various drawbacks of operation.

DETAILED DESCRIPTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention comprises a tool comprising a pair of levers which are movable relative to one another. In one embodiment, the tool comprises pliers having a pair of levers or halves which are moveable between a first or open position and a second or closed position, and which include at least one biasing member or mechanism configured to bias the pliers into at least one of the first or second positions. In one embodiment, the biasing member comprises a spring which is encapsulated or contained within the plier levers at a hinge or pivot thereof and which is configured to bias the pliers into an open position.

Figure 1:
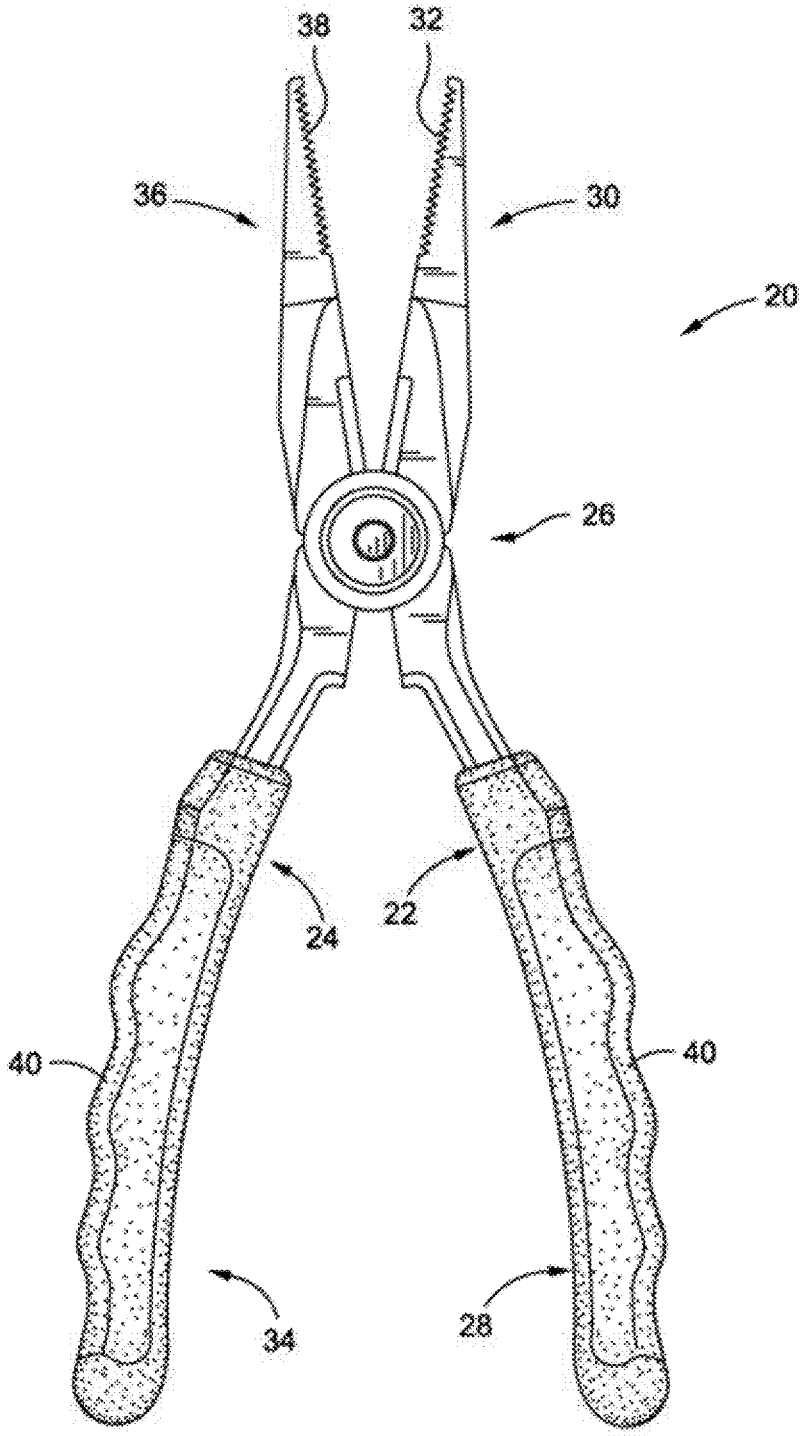
FIG. 1 is a perspective view of one embodiment of pliers in accordance with the present invention.

One embodiment of the invention will be described with reference to FIGS. 1-3. As illustrated in FIG. 1, a tool/pliers 20 of the invention comprise a first plier/tool half or lever 22 and a second plier/tool half or lever 24. The first and second plier levers 22, 24 are movably jointed at a joint 26, as described in more detail below.

In one embodiment, the first plier lever 22 has a first end 28 and an opposing second end 30. The first end 28 may be configured as a grip. In one embodiment, the first end 28 may thus be configured to be slightly arcuate, bending inwardly towards the second plier lever 24.

The second end 30 of the first plier lever 22 may be configured as one half of a tool head or jaw. As illustrated, the pliers 20 may be configured as needle-nose type pliers. In such a configuration, the second end 30 of the first plier lever 22 may have a tapered end. The second end 30 may define a contact or jaw surface 32. The contact surface 32 may be smooth and/or include one or more serrations or other features for use in improving engagement of the tool 20 with other features, including for securing the pliers to such an object or cutting the object.

The second plier lever 24 may also have a first end 34 and a generally opposing second end 36. The first end 34 may be configured as a grip and may also be slightly arcuate, bending inwardly towards the first plier lever 22.

The second end 36 of the second plier lever 24 may be configured as a second half of a tool head or jaw for mating with the first half defined by the first plier lever 22. In the embodiment where the pliers 20 are configured as needle-nose type pliers, the second end 36 of the second plier lever 24 may also have at tapered end. As with the first plier lever 22, the second end of the second plier lever 24 may define a contact surface 38 which may be smooth and/or include one or more serrations or other features for use in improving engagement of the tool 20 with other features.

In one embodiment, the first and second plier levers 22, 24 may be constructed from a durable metal. For example, the first and second plier levers 22, 24 may be constructed in a metal forging process.

As indicated below, the first and second plier levers 22, 24 may be movably connected to one another. So connected, the pliers 20 have a first end for gripping by a user, the first end comprising the first ends of the first and second plier levers 22, 24. The pliers 20 have an opposing second or "jaw" end comprising the second ends of the first and second plier levers 22, 24.

In order to increase user comfort when gripping the first ends 28, 34 of the first and second plier levers 22, 24 during use of the tool 20, a coating or grip may be applied to thereto. As illustrated, for example, a plastic, rubber or similar high friction, durable grip 40 may be placed over or applied to the first ends 28, 34 of the first and second plier levers 22, 24. The grips 40 may be various colors, have finger contours, detents or the like.

Of course, the basic configuration of the pliers 20 may vary. For example, the pliers 20 might be configured to have cutting or crimping jaws, be flat-nosed, round-nosed, etc. Also, the shapes of the first ends 28, 34 of the first and second plier halves 22, 24 may vary, as may their length, such as depending upon the application.

As indicated above, the first and second plier levers 22, 24 may be connected or joined at a joint 26. In one embodiment, the joint 26 is located between the first and second ends of each of the first and second plier levers 22, 24. The joint 26 may be located closer to the second ends 30, 36 of the first and second plier levers 22, 24 so that a high lever force is generated at the second ends 30, 36 when a user grips the first ends 28, 34.

Details of the plier joint 26 will be described with reference to FIG. 2. As illustrated therein, in one embodiment the joint 26 comprises a housing 42, at least one biasing element 44 and at least one coupler 46.

The housing 42 may be configured to house the at least one biasing element 44. In one embodiment the housing 42 comprises a first housing section or portion 48 and a mating second housing section or portion 50. The first housing portion 48 may be defined by or associated with the first plier half 22. The second housing portion 50 may be defined by or associated with the second plier half 24. When coupled, the first and second housing portions 48, 50, in one embodiment, define an interior area or space 52 of the housing 42.

In one embodiment, the at least one biasing element 44 is located inside of the housing 42. In one embodiment, the biasing element 44 comprises a coiled torsion spring. The spring 44 comprises a body having a first end 54 and a second end 56 and an intermediate section or body 58. In one embodiment, the intermediate section 58 is coiled. The first and second ends 54, 56 extend outwardly from the intermediate section 58 generally transverse or perpendicular thereto. In one embodiment, the first end 54 and second end 56 extend outwardly generally 180 degrees from one another about the intermediate section 58, in generally opposing directions. Due to the coiled configuration of the torsion spring 44, the first end 54 is located at the top of the spring and the second end 56 is located at the bottom of the spring (i.e. the first and second ends 54, 56 are not located at exactly the same elevation, though they are generally located in the same plane as the body 58 of the spring 44).

In one embodiment, the first housing portion 48 defines a seat 60 in the interior thereof. The seat 60 may be situated downwardly from a top rim 62 of the first housing portion 48. In addition, the first housing portion 48 defines a mount 64 for the second end 56 of the torsion spring 44. This mount 64 may comprise a detent or recess in the wall of the first housing portion 48, the detent extending outwardly from the seat 60.

The second housing portion 50 may define a similar seat 61 (see FIG. 3B) in the interior thereof. The seat may be situated downwardly from a top rim 66 of the second housing portion 50. In addition, the second housing portion 50 may define a similar mount 65 (see FIG. 3B) for the first end 54 of the torsion spring 44. This mount may similarly comprise a detent or recess in the wall of the second housing portion 50, the detent extending outwardly from the seat.

As indicated, in one embodiment, the biasing member comprises a coiled torsion spring 44. So that the torsion spring 44 is tightly captured in the housing 42, the interior space defined by the first and second housing portions 48, 50 may be generally cylindrical. As illustrated, for example, the seat 60 of the first housing portion 48 is generally circular, having an outside diameter approximately the same as the outside diameter of the spring 44 and an inside diameter approximately the same as the inside diameter of the spring 44.

As also indicated above, the pliers 20 further comprise at least one coupler 46. The coupler 46 may rotatably connect the first and second plier levers 22, 24.

In one embodiment, the coupler 46 connects the first and second plier levers 22, 24. In one embodiment, the coupler 46 comprises interconnecting first and second members, such as a first or male connector or fastener 68 and a mating second or female connector or fastener 70. The male fastener 68 may have the form of a threaded screw or bolt. As illustrated, the male fastener 68 may have a head 72 and a shank 74 which is at least partially threaded.

The female fastener 70 may have the form of a threaded bushing. The bushing may have a head 76 and a sleeve 78 which extends outwardly from the head 76. The sleeve 78 may have a reduced diameter relative to the head 76. The bushing may define a passage through at least a portion of the sleeve 78 (and such passage may extend all the way through the bushing), at least a portion of the passage being internally threaded and configured to accept at least a portion of the threaded shank 74 of the male fastener 68.

The coupler 46 extends through the pliers 20 from a first side to a second side thereof. As illustrated, the head 72 of the male fastener 68 may be located at the outside of the first plier lever 22 and extend through the first and second plier levers 22, 24 to the head 76 of the female fastener 70 which is located at the outside of the second plier lever 24.

In order to facilitate the passage of the coupler 46 through the pliers 20, a passage is defined through the housing 42. In one embodiment, the first plier lever 22 defines a passage 80 at the first housing portion 48. This passage 80 may be centrally located and arranged so that the seat 60 encircles the passage 80 and so that the coupler 46 extends through the torsion spring 44 which is located on the seat 60. Likewise, the second plier lever 22 may define a similar passage 82 there through. Again, this passage 82 may extend through the second housing portion 50.

As indicated, the male fastener 68 is configured to selectively engage the female fastener 70 in a manner which creates a locking or joining force which maintains the first and second plier levers 22, 24 in close proximity. Because the first and second plier levers 22, 24 are joined about a cylindrical coupler, however, they are permitted to freely rotate relative to one another, such as between open and closed positions.

In order to facilitate smooth rotation of the first and second plier levers 22, 24 relative to the coupler 46, the coupler may include a secondary bushing 84. The secondary bushing 84 may have a head 86 and a sleeve 88 and may define a passage there through. The head 86 is configured to engage the outside of the plier lever at which the head 72 of the male fastener 68 is located, such as at the first plier lever 22. The head 86 of the secondary bushing 84 is configured to be positioned between that plier lever and the head 72 of the male fastener 68. The sleeve 88 of the secondary bushing 84 then extends into the passage 80 defined by the first housing portion 48. In this manner, the first and second plier levers 22, 24 are mounted for rotation around the bushing which comprises the female fastener 70 and the secondary bushing 84. This configuration promotes free and smooth rotation of the first and second plier levers 22, 24 because they rotate around or relative to the smooth surfaces of the bushings rather than the threaded shank 74 and small head 72 of the male fastener 68.

Figure 3A:
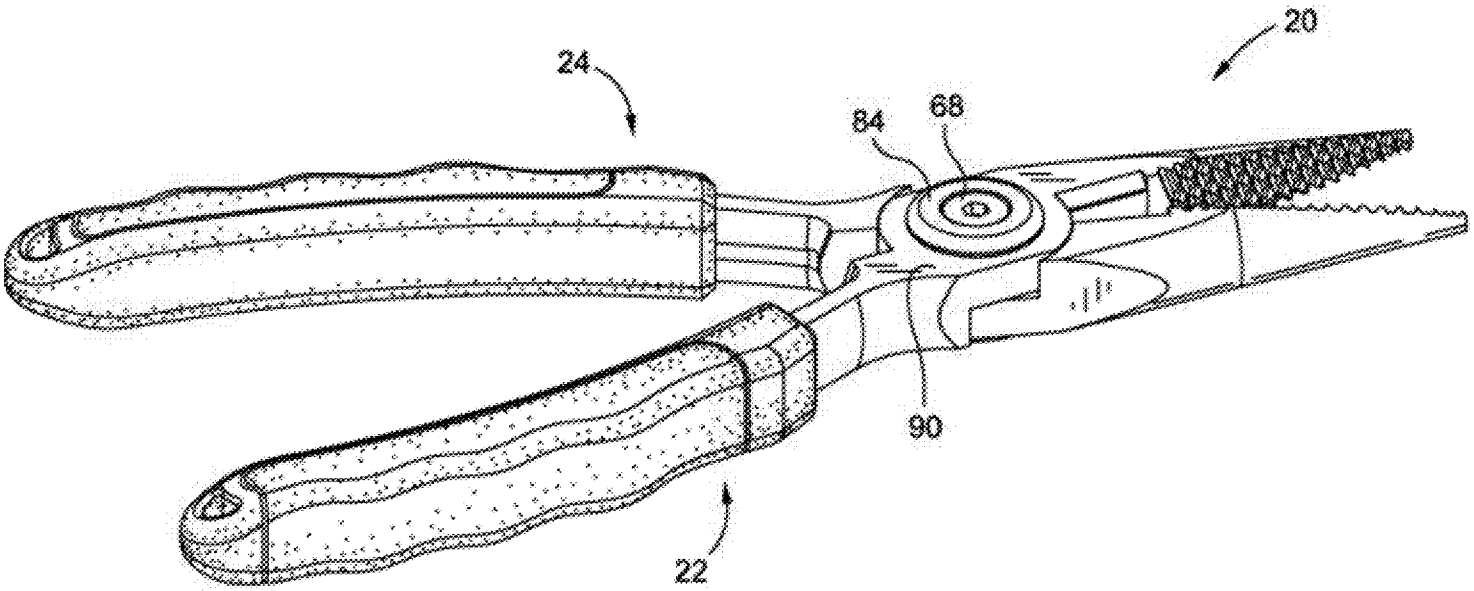
FIG. 3A is a perspective view of an embodiment of pliers having a non-flush coupler.
Figure 3B:
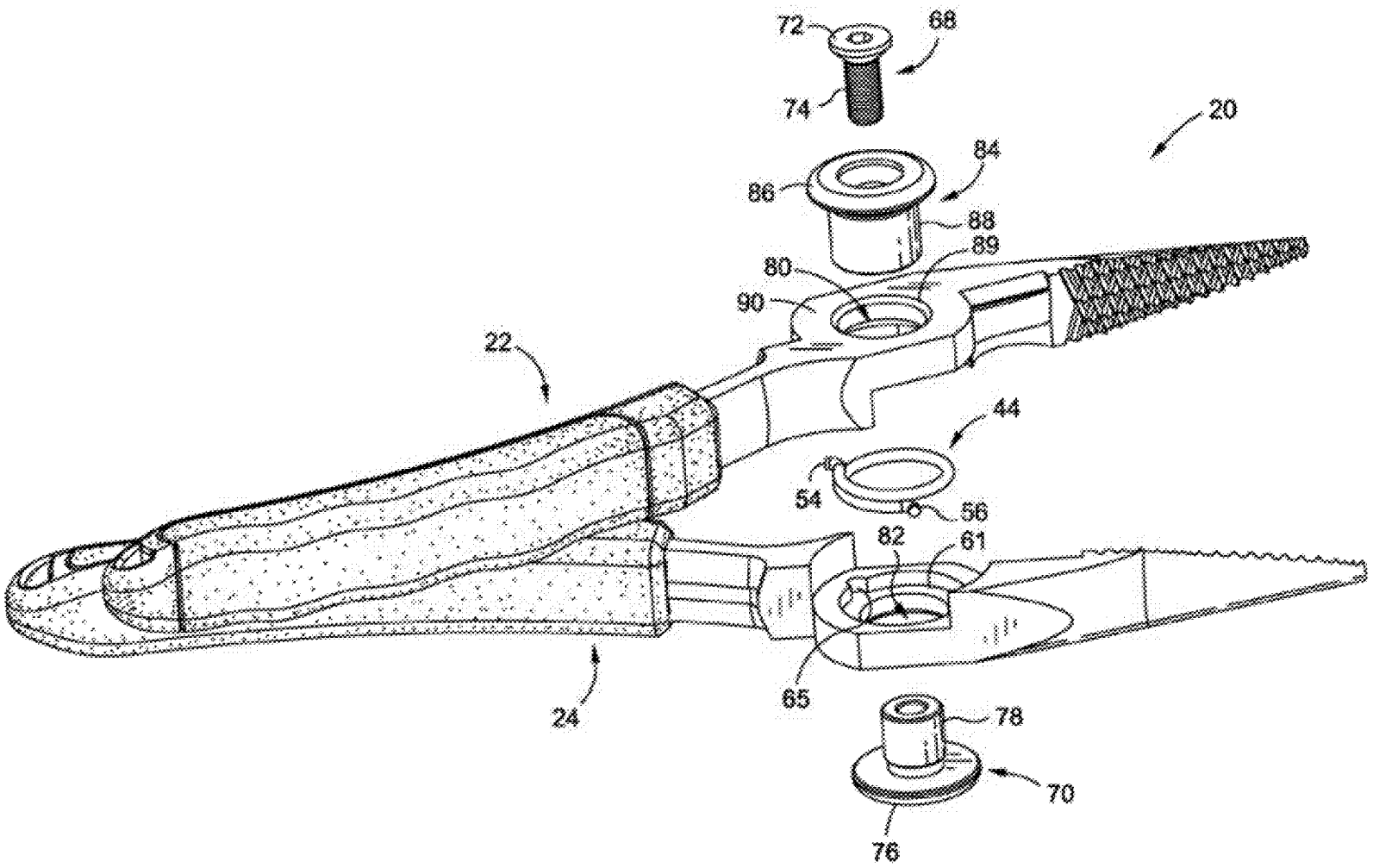
FIG. 3B is an exploded view of the pliers illustrated in FIG. 3A.

In one embodiment, as illustrated in FIGS. 3A and 3B, an outside/exterior face or surface 90 of the first plier lever 22 about at least the passage 82 is generally planar and smooth. The head 86 of the secondary bushing 84 is configured to extend outwardly beyond the circumference of the passage 80 so that a bottom surface of the head 86 rests upon the outside face 90 of the first plier lever 22, or a tapered or beveled edge 89 thereof at the passage 80. In this configuration, the head 86 of the secondary bushing 84 protrudes outwardly from the outside face 90 of the first plier lever 22, such that the connection at the joint thereof is non-flush as best illustrated in FIG. 3B.

Figure 4A:
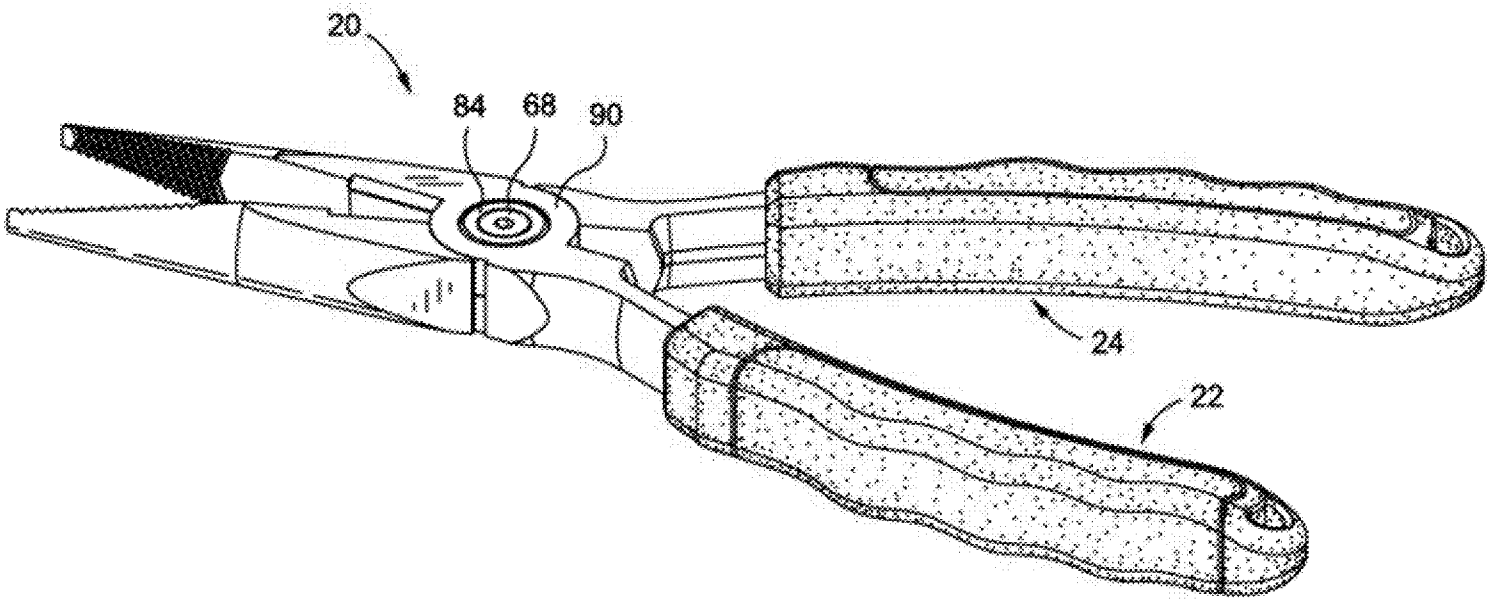
FIG. 4A is a perspective view of an embodiment of pliers having a flush coupler.
Figure 4B:
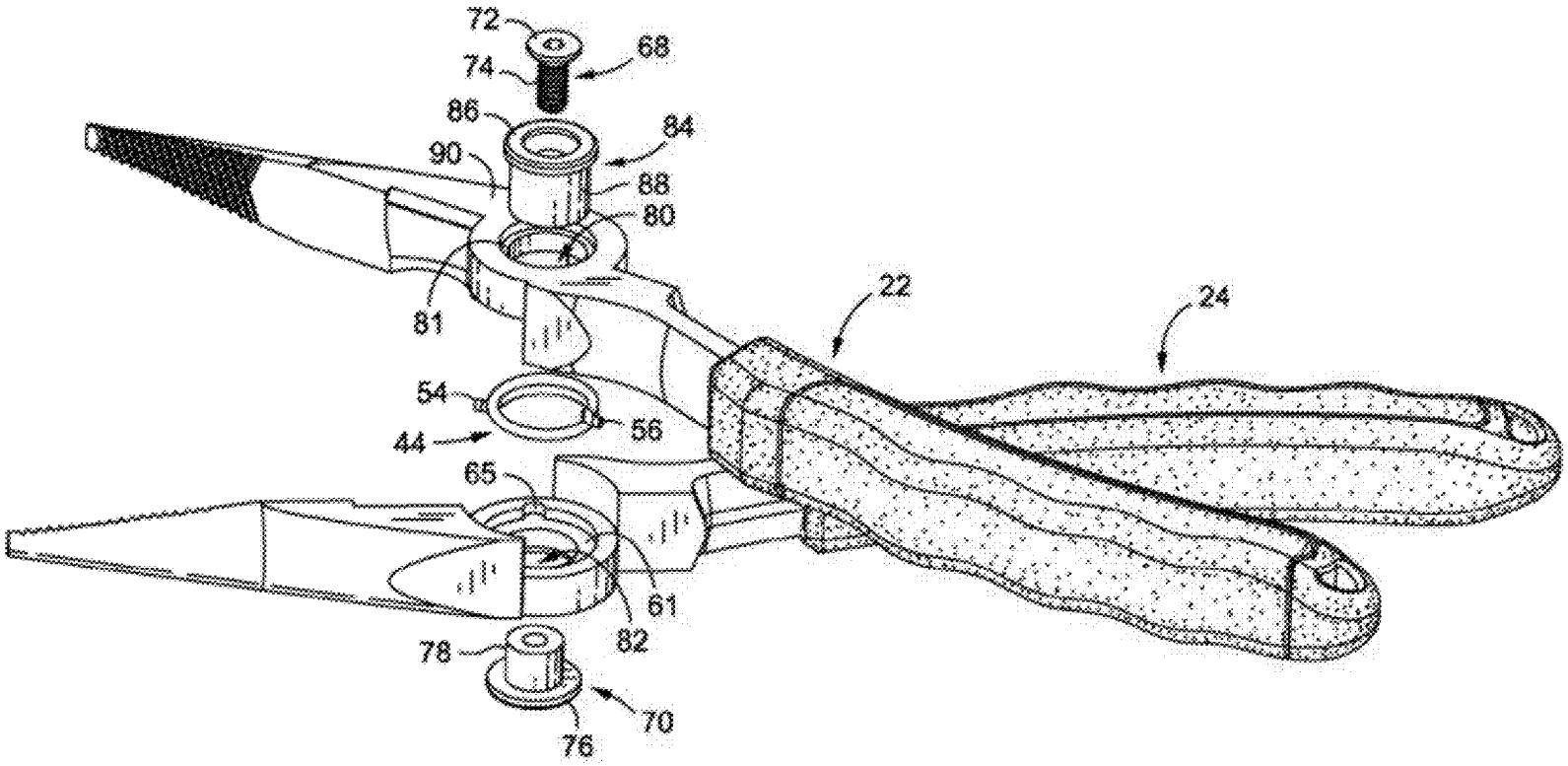
FIG. 4B is an exploded view of the pliers illustrated in FIG. 4A.

In another embodiment, as illustrated in FIGS. 4A and 4B, the passage 80 may include an enlarged section 81 which is configured to accept the head 86 of the secondary bushing 84. As illustrated in FIG. 4A, this allows the head 86 of the secondary bushing 84 to fit within the first plier lever 22 so that an end or top surface of the head 86 is generally flush with or at least does not extend beyond, the outer surface 90 of the first plier lever 22.

In one embodiment, as illustrated in both FIGS. 3A and 4A, the male fastener 68 may be configured to be located in the secondary bushing 84. In particular, the secondary bushing 84 may include a recess for accepting the head 72 of the male fastener 68, whereby the head 72 of the male fastener 72 does not protrude outwardly beyond the secondary bushing 84.

It will be appreciated that the connection of the female fastener 70 may be similarly configured to either be a flush or non-flush mount. For example, the passage 82 through the second plier lever 24 may include a recessed portion for accepting the head 76 of the female fastener 70 so that the top or end thereof is generally flush with an exterior or outer surface 91 of the second plier lever 24. Alternatively, the head 76 of the female fastener 70 could extend outwardly of the outer surface 91, as illustrated in FIG. 2.

In one embodiment, the sleeve 78 portion of the female fastener 70 is close in size to the passage 82, such as being only slightly smaller in diameter, so that the second plier lever 24 rotates about an axis through the passage 82 (and does not wobble or tilt).

Figure 2:
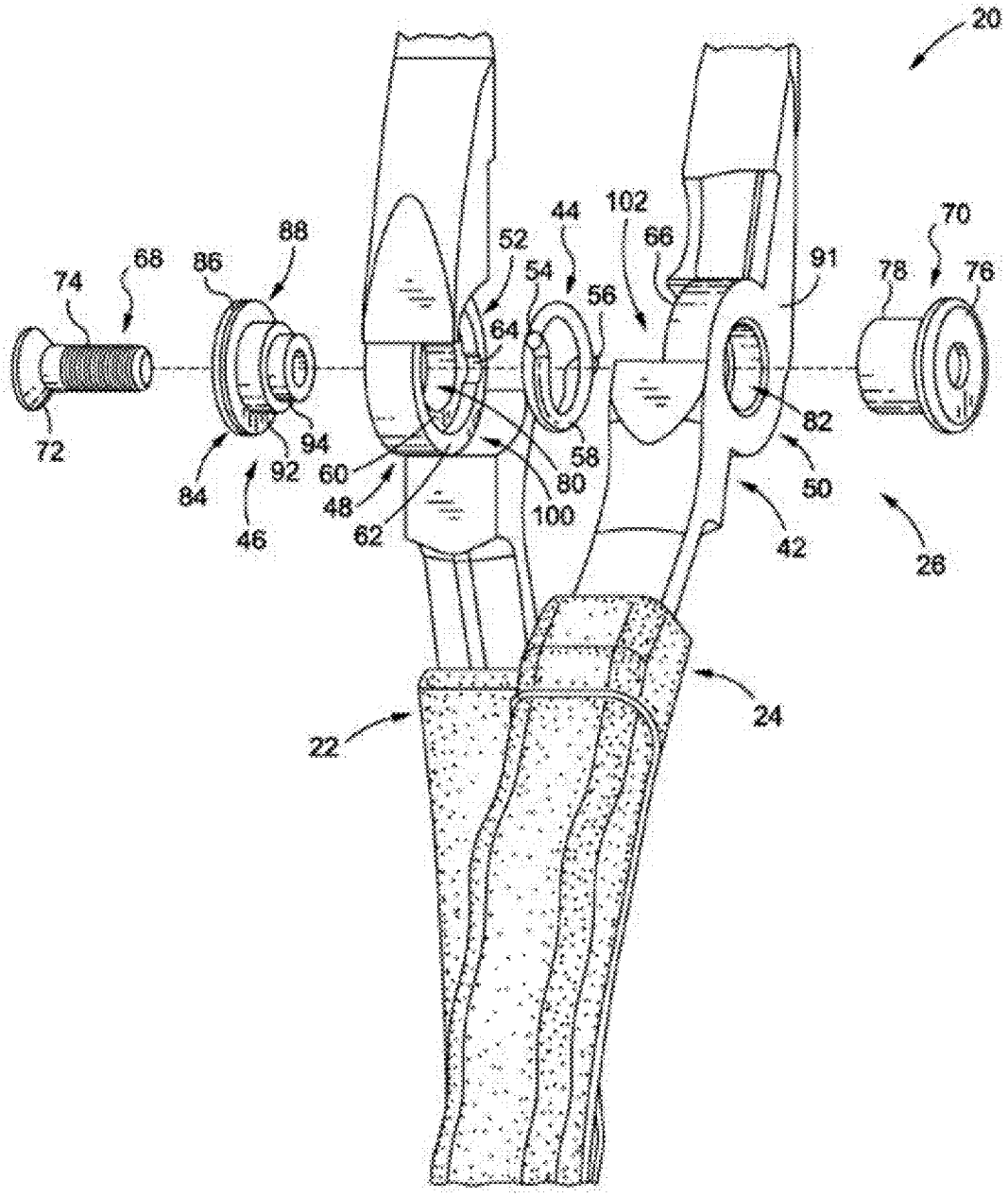
FIG. 2 is an enlarged perspective view of a hinge portion of one plier lever.

In one embodiment, referring to FIG. 2, the sleeve 88 of the secondary bushing 84 has a first portion 92 and a second portion 94. The first portion 92 may have a size close to that of the passage 80 through the first housing portion 48. For example, the diameter of the first portion 92 of the sleeve 88 of the secondary bushing 84 may be close in diameter to the passage 80, whereby the first plier lever 22 rotates about an axis through the passage 80 (and does not wobble or tilt).

The second portion 94 of the sleeve 88 of the secondary bushing 84 may extend from the first portion 92 and it may have a reduced diameter or size, such as to permit it to fit within or otherwise engage the passage through the bushing which comprises the female fastener 70 (or to fit within an enlarge portion of such a passage at the end of the sleeve 78 thereof), whereby the secondary bushing 84 and the female fastener 70 engage or connect to one another.

Referring to FIG. 1 again, when the coupler 46 is coupled, the housing 42 defined by the first and second housing portions 48, 50 is closed. The torsion spring 44 is located in the interior area of that housing 42, completely closed therein.

The engagement of the ends 54,56 of the torsion spring 44 with the notches or mounts 64,65 in each housing portion 48, 50, causes the first and second plier levers 22, 24 to be biased into their open position as illustrated in FIG. 1.

In one embodiment, the first and second housing portions 48, 50 each have a depth of approximately one-half of the depth or thickness of their respective first and second plier levers 22, 24. In one embodiment, the first and second plier lever 22, 24 each have a generally planar inner face (facing the other plier lever) and a generally planar outer face (which serve as the outside surfaces or faces of the pliers 20).

In one embodiment, the first housing portion 48 is located at the outside of the first plier lever 28, whereby a recess 100 is located adjacent to the first housing portion 48. Likewise, the second housing portion 48 is located at the outside of the second plier lever 24, whereby a recess 102 is located adjacent to the second housing portion 50. When the first and second plier levers 22, 24 are connected, the depth or thickness of the housing 42 is, in one embodiment, the same as the depth or thickness of each plier lever 22, 24. In particular, the first housing portion 48 associated with the first plier lever 22 fits within the recess 102 defined by the second plier lever 24, and the second housing portion 50 associated with the second plier lever 24 fits within the recess 100 defined by the first plier lever 22.

In one embodiment, at least the outside or exterior of the sleeve 78 of the female fastener and of the sleeve 88 of the secondary bushing 84 is smooth. This promotes smooth rotation of the plier levers 22, 24 relative to the coupler 46. In fact, in some embodiments the outside of the female fastener 70 and the secondary bushing 84 may be constructed of or comprise a low friction material or be lubricated.

The pliers 20 of the invention have numerous advantages. One advantage is that the ends 54, 56 of the torsion spring 44 extend outwardly in generally the same plane as the body 58 of the spring. In this manner, the spring 44 has a low or thin profile, thus allowing it to fit within a housing 42 which has a thinner or lower profile than would be required for other spring configurations. This allows the pliers 20 to have an overall thin profile, which is important when the pliers 20 are to be used in small spaces.

Also, the torsion spring 44 is located between seats of the two housing portions 48, 50 and is thus secured thereby, rather than being located in an open space and requiring other securing mechanisms. In this regard, the spring 44 is essentially self-locating, which improves the ease of manufacture of the pliers 20.

A particular advantage of the pliers 20 is that the plier levers 22, 24 rotate about bushings 70, 84, rather than a threaded connector. In particular, the mounting of the plier levers 22, 24 about the bushings 70, 84 causes the plier levers 22, 24 to rotate smoothly (without binding) and about the axes there through (i.e. without wobbling or tilting, which could cause binding or cause the jaws of the plier levers 22, 24 to move out of alignment). Also, this mounting serves to further fix the torsion spring 44 because the coupler 46 passes tightly through the torsion spring 44, preventing it from moving.

Another benefit of the invention is that the housing 42 and coupler 46 are compact and flush with the faces of the pliers 22, 24, causing the pliers to be generally planar on each side and thin in profile.

It will be appreciated that the pliers 20 of the invention may have other configurations. In one embodiment, the pliers 20 comprise fixed-joint pliers, though they could have other configurations. As indicated, the shape of the plier levers 22, 24 may vary, including so that the configuration of the jaws vary, such as for different purposes.

It is possible for the coupler 46 to have other configurations. First, the configuration of the coupler 46 may be reversed. In such a configuration, the female fastener 70 may mount to the first plier lever 22 rather than the second plier lever 24.

In addition, the coupler 46 might comprise a single female bushing having a sleeve which extends entirely through the housing 42, and having a male fastener with an enlarged head with a shank that engages the female fastener (thus eliminating the secondary bushing while still causing both the first and second plier levers 22, 24 to rotate about the sleeve of at least one bushing). In another configuration, the secondary bushing 84 and male fastener 68 might be integrated (such as by comprising a bushing having a head with a tool recess, having a main body or shank in the form of a sleeve and a second end comprising a threaded extension). Also, while the male and female fasteners may engage in a threading configuration, they might engage in other manners, such as by pressing the shank of the male fastener into the female fastener (press-fit) or through the female fastener wherein a tail may be connected to or formed at the end of the shank to lock the male and female fasteners together.

In yet another embodiment, the coupler 46 might comprise a central bushing which extends through the first and second plier levers 22, 24 and first and second ends or caps. Each cap may have a generally planar head and a have a shank which extends into or otherwise engages an end of the central bushing, whereby the caps "close" each end of the central bushing at either side of the pliers.

Figure 5:
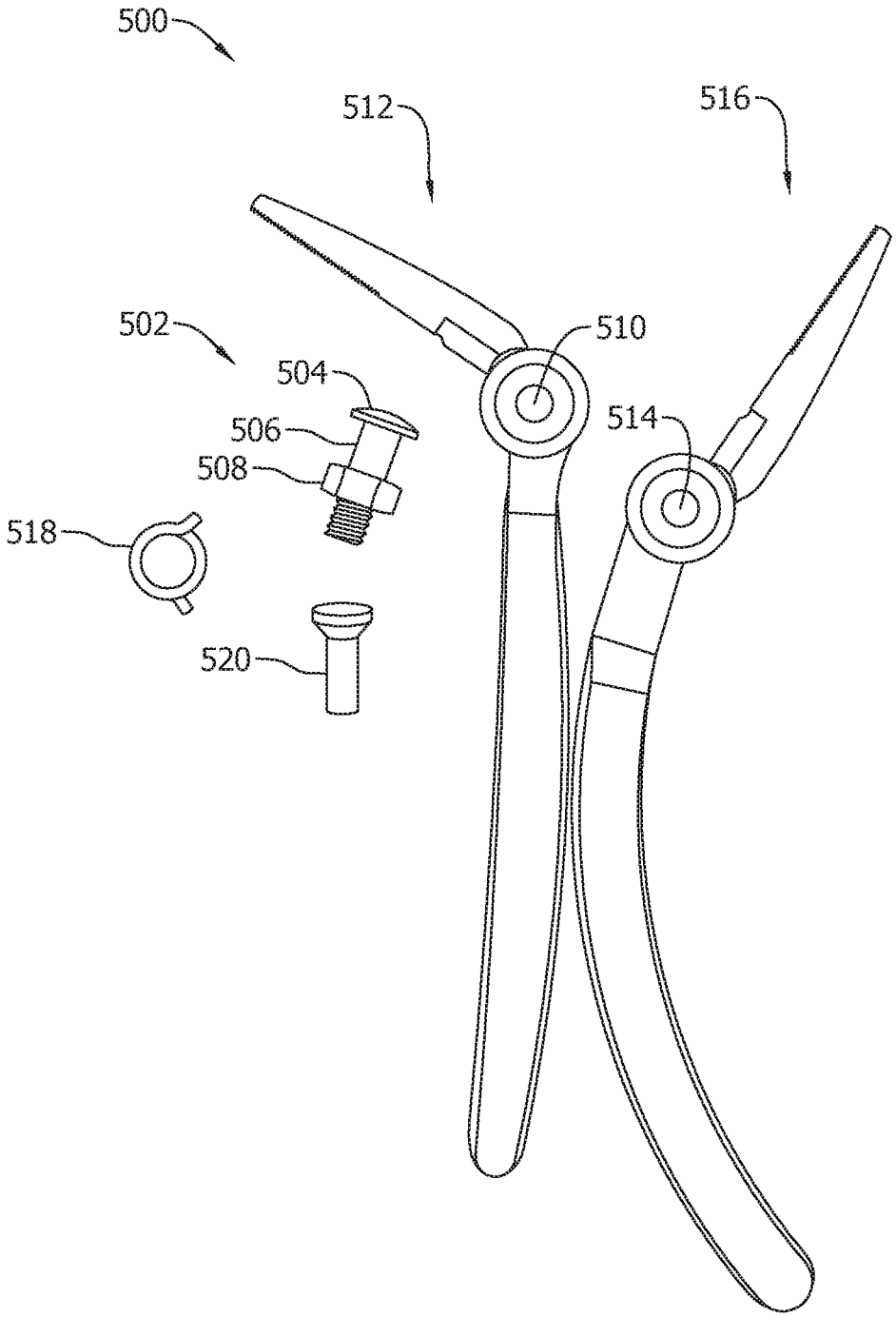
FIG. 5 is a side view diagram illustrating another embodiment of the pliers.

FIG. 5 is a side view diagram illustrating another embodiment of the pliers in accordance with embodiments of the disclosure. In one embodiment, the pliers 500 may be assembled with a first temporary fastener 502 that is useful for maintaining the orientation of the pliers 500 during a hardening or heating process. The temporary fastener 502, as depicted, may comprise a bolt 504 having a shank 506 that engages a nut 508. In one embodiment, the shank 506 is selected with a length configured to pass from an opening 510 of the first tool half 512 to an opening 514 of the second tool half 516. Similarly, the diameter of the shank 506 may be selected to engage the opening 510. In other words, the dimensions of the fastener 502 are selected to optimally join the first tool half 512 to the second tool half 516 during a hardening or heat treating process.

In some embodiments, the biased member 518 may be inserted into a housing created by the first tool half 512 and the second tool half 516 during the hardening or heat treating process. Alternatively, the biased member 518 may be inserted into the plier 500 following the heat treating or hardening process. A permanent fastener 520 may be used to permanently couple the first tool half 512 to the second tool half 516. The permanent fastener 520, in one embodiment, is a solid rivet having dimensions selected to pass through the openings 510, 514.

The permanent fastener 520, in one embodiment, includes a flanged head configured to engage a beveled outer surface of either the first tool half 512 or the second tool half 516. The end opposite the flanged head is configured to be pressed or deformed to conform with a beveled or recessed area in either the first tool half 512 or the second tool half 516. The permanent fastener 520 may be, in one embodiment, a solid rivet formed of a material that is substantially similar to the first tool half 512 and the second tool half 516. In other embodiments, the permanent fastener 520 is formed of a material that visually resembles the material of the first tool half 512 and the second tool half 516.

Figure 6:
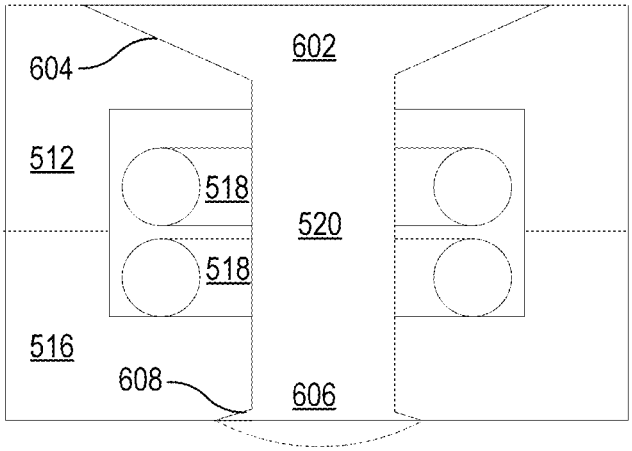
FIG. 6 is a cross-sectional diagram illustrating one embodiment of the housing formed by the first tool half and the second tool half in accordance with embodiments of the disclosure.

FIG. 6 is a cross-sectional diagram illustrating one embodiment of the housing formed by the first tool half and the second tool half in accordance with embodiments of the disclosure. The first tool half 512 may be coupled to the second tool half 516 by way of the permanent fastener 520. In the depicted embodiment, a permanent fastener 520 having a flanged or countersunk head 602 is selected to engage a beveled or chamfered opening 604 in the first tool half 512. The chamfer angle of the flanged head 602 may be in the range of between about 60 and 120 degrees.

The opposite, or deformed end 606 is deformed or "mushroomed" to conform with a chamfered opening 608 of the second tool half 516. The deforming process causes the first tool half 512 and the second tool half 516 to be drawn together and subsequently form the housing for the biased member 518. The deformed or mushroomed region (depicted by the dashed line) may then be ground smooth to form a flush surface with the adjacent surface of the second tool half 516.

Figure 7:
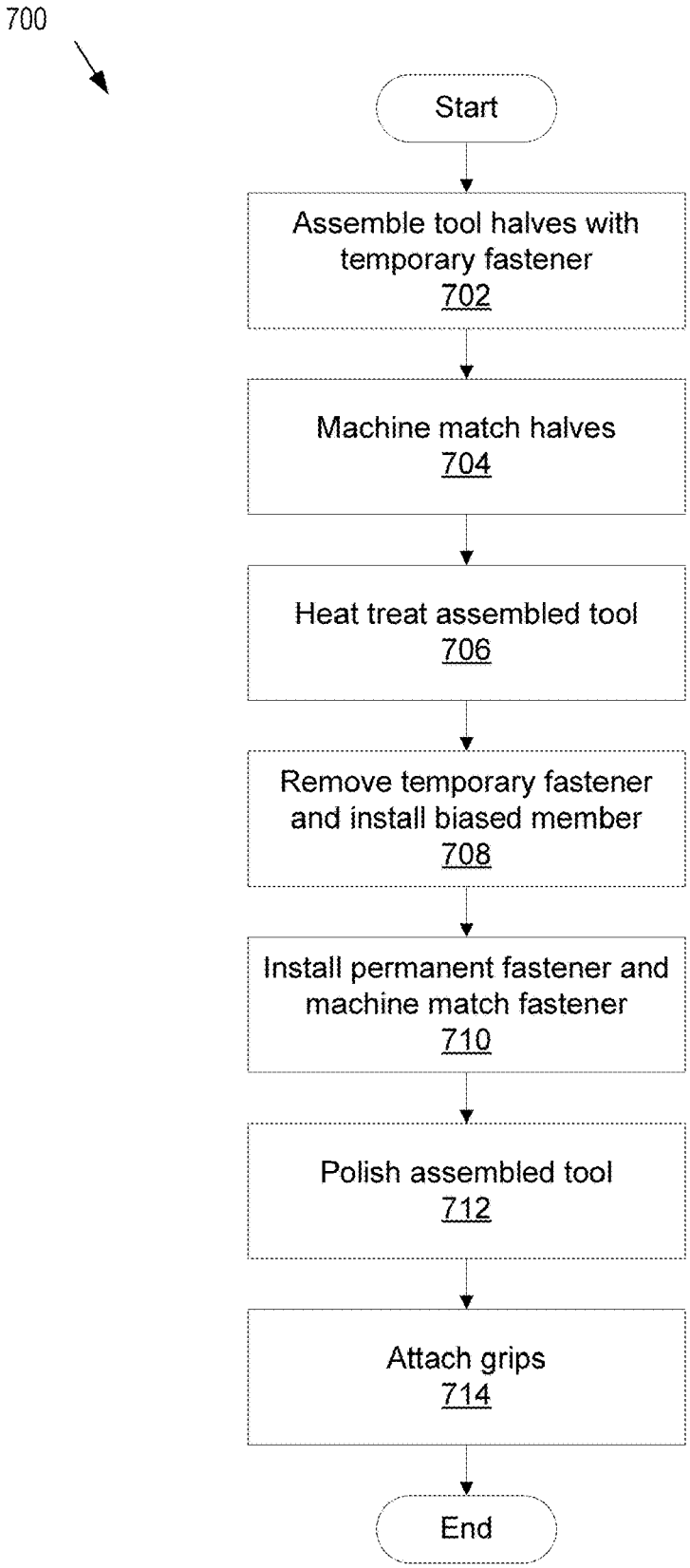
FIG. 7 is a schematic flow chart diagram illustrating one embodiment of a method for manufacturing a plier using a temporary fastener and a permanent fastener in accordance with embodiments of the disclosure.
Figure 8:
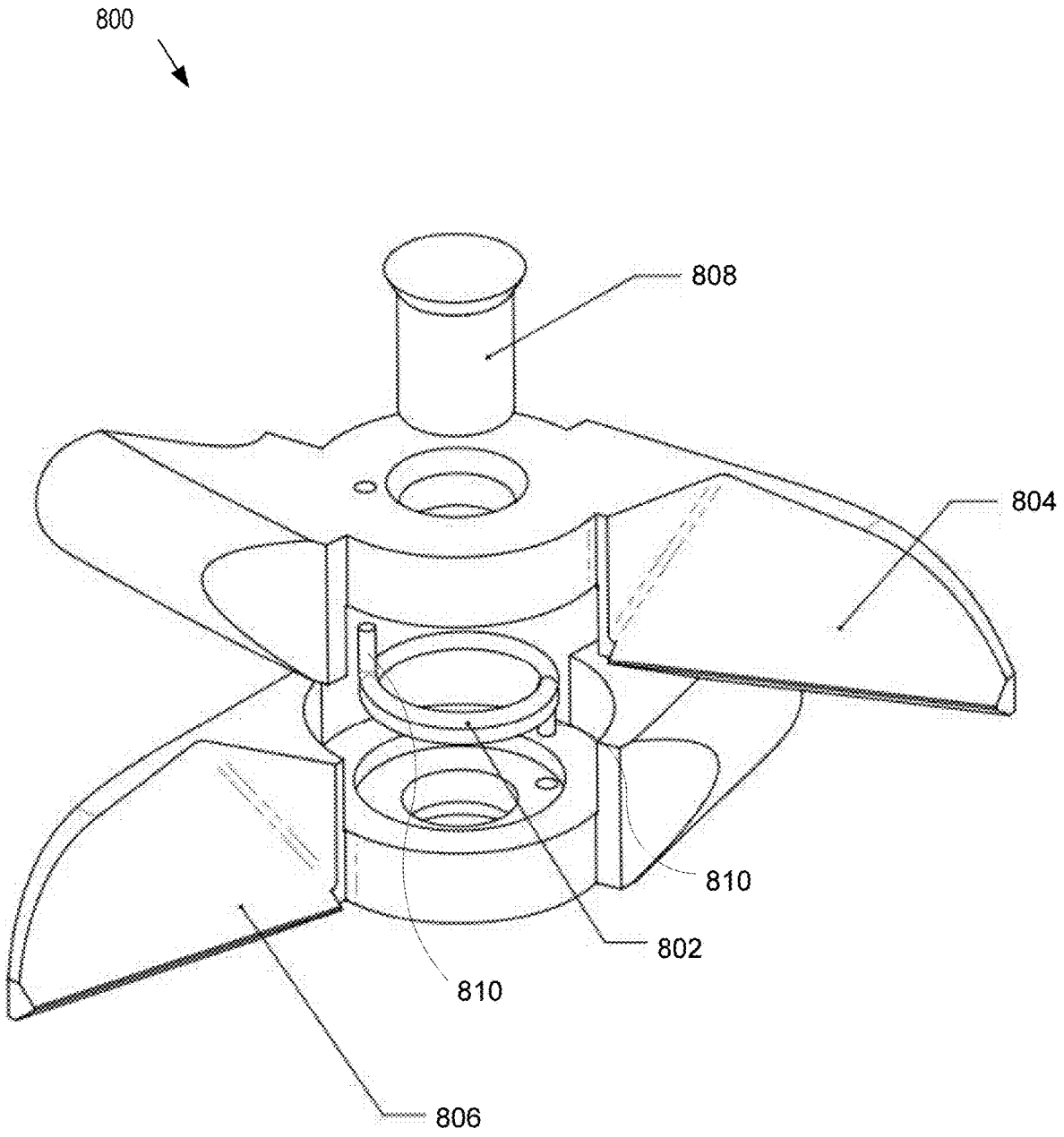
FIGS. 8-11 are perspective view diagrams illustrating stages of manufacturing a plier in accordance with embodiments of the present disclosure.
Figure 9:
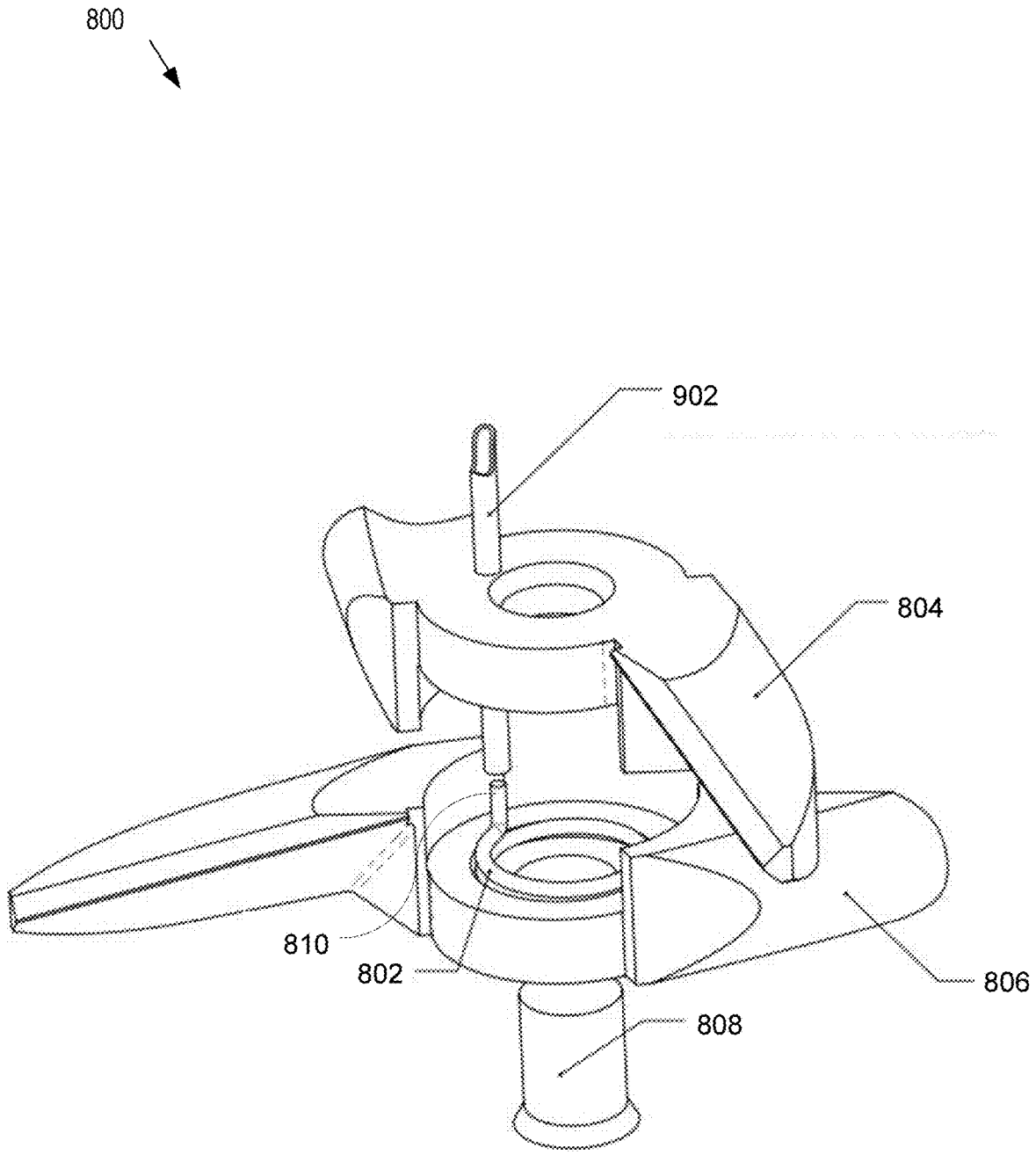

FIG. 7 is a schematic flow chart diagram illustrating one embodiment of a method for manufacturing a plier using a temporary fastener and a permanent fastener in accordance with embodiments of the disclosure. In one embodiment, the method 700 starts and the first tool half 512 and the second tool half 516 are assembled, at block 702, with the temporary fastener. The temporary fastener, in one example, is a non-hardenable fastener. In other words, the hardening or heat treating process will not affect the temporary fastener.

At block 704, the first tool half 512 and the second tool half 514 are machined (i.e., ground) to precisely join the first tool half 512 and the second tool half 514. At block 706, the first tool half 512 and the second tool half 514 are heat treated or hardened by any one of various hardening processes including, but not limited to, forging. At block 708, the temporary fastener is removed and the biased member is positioned between the first tool half and the second tool half, if not previously positioned. Stated differently, the biased member may be positioned in the housing before the hardening or heat treating process.

At block 710, the permanent fastener is inserted into the first tool half so that the permanent fastener passes through the opening of the first tool half, the biased member, and the opening of the second tool half (see FIG. 6). The permanent fastener, in one embodiment, is then deformed. In the example where the permanent fastener is a rivet, the non-flanged end is deformed to conform with a chamfered or beveled opening of the second tool half.

At block 712, the deformed head (depicted by the dashed line of FIG. 6) is then machined, or ground to match the surface of the second tool half 516, and a final polishing of the tool may be performed. At block 714, grips may be attached. Various different methods are contemplated for attaching grips, including, but not limited to dipping the tool into a polymer that coagulates and forms a grip on handles of the tool. The method 700 then ends.

FIGS. 8-11 are perspective view diagrams illustrating stages of manufacturing a plier in accordance with embodiments of the present disclosure. In the depicted embodiment, a plier head 800 is assembled using a biased member, or spring 802. As discussed above, the biased member 802 is disposed within a cavity formed by a first tool half 804 and a second tool half 806. Although the depicted first and second tool halves 804, 806 are dual-head (i.e., dual sets of plier jaws), the disclosed methods and structures are equally applicable to traditional pliers.

As described above with reference to FIG. 6, a deformable fastener 808 may be used to couple the first tool half 804 to the second tool half 806 by deforming an end of the fastener 808. The biased member 802 may be formed with axially extending ends 810 that are insertable into corresponding openings in either the first tool half 804 or the second tool half 806. However, aligning the biased member ends 810 with the openings is a difficult task while assembling the tool halves 804, 806.

Beneficially, the disclosed method of manufacture overcomes this by providing a temporary sleeve 902 (FIG. 9) that extends through an opening of the first tool half 804. The temporary sleeve 902 is configured with an outer diameter that is smaller than the opening in the first tool half 804, but an inner diameter that is larger than the end 810 of the biased member 802. Accordingly, the temporary sleeve 902 aligns the end 810 of the biased member 802 with the opening in the first tool half 804 and allows for easy assembly of the first and second tool halves 804, 806.

Figure 10:
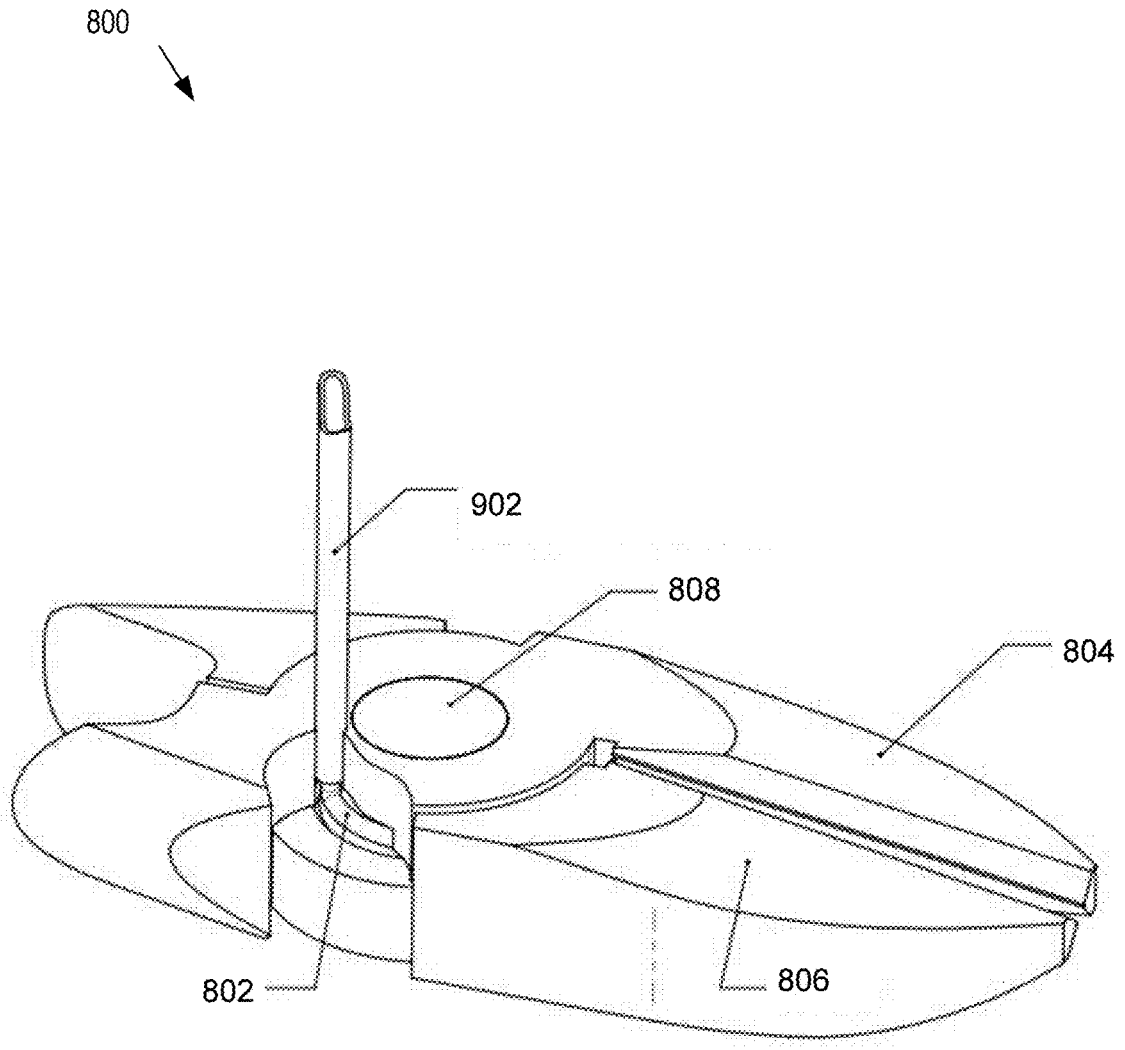
Figure 11:
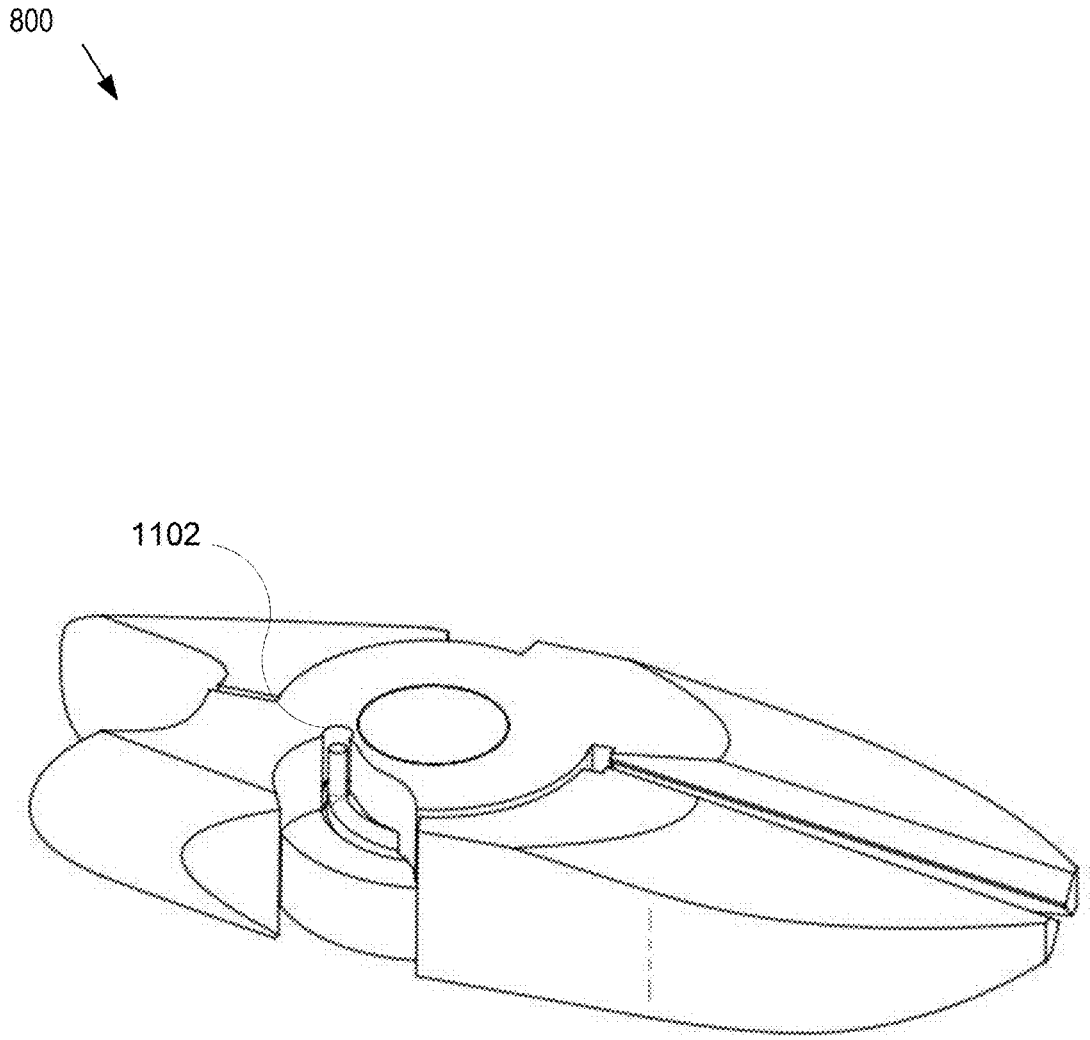

FIG. 10 illustrates a cut-away view of the assembled tool halves 804, 806 to depict how the temporary sleeve 902 engages the end 810 of the biased member 802. Once assembled, the temporary sleeve 902 may be removed (see FIG. 11) and the result is a biased tool jaw. A plug may then be inserted in the opening 1102 to seal the opening. For example, a deformable metal may be inserted and impacted to deform the metal (i.e., "mushroom" the metal member) and subsequently grind the surface of the tool smooth.

Figure 12:
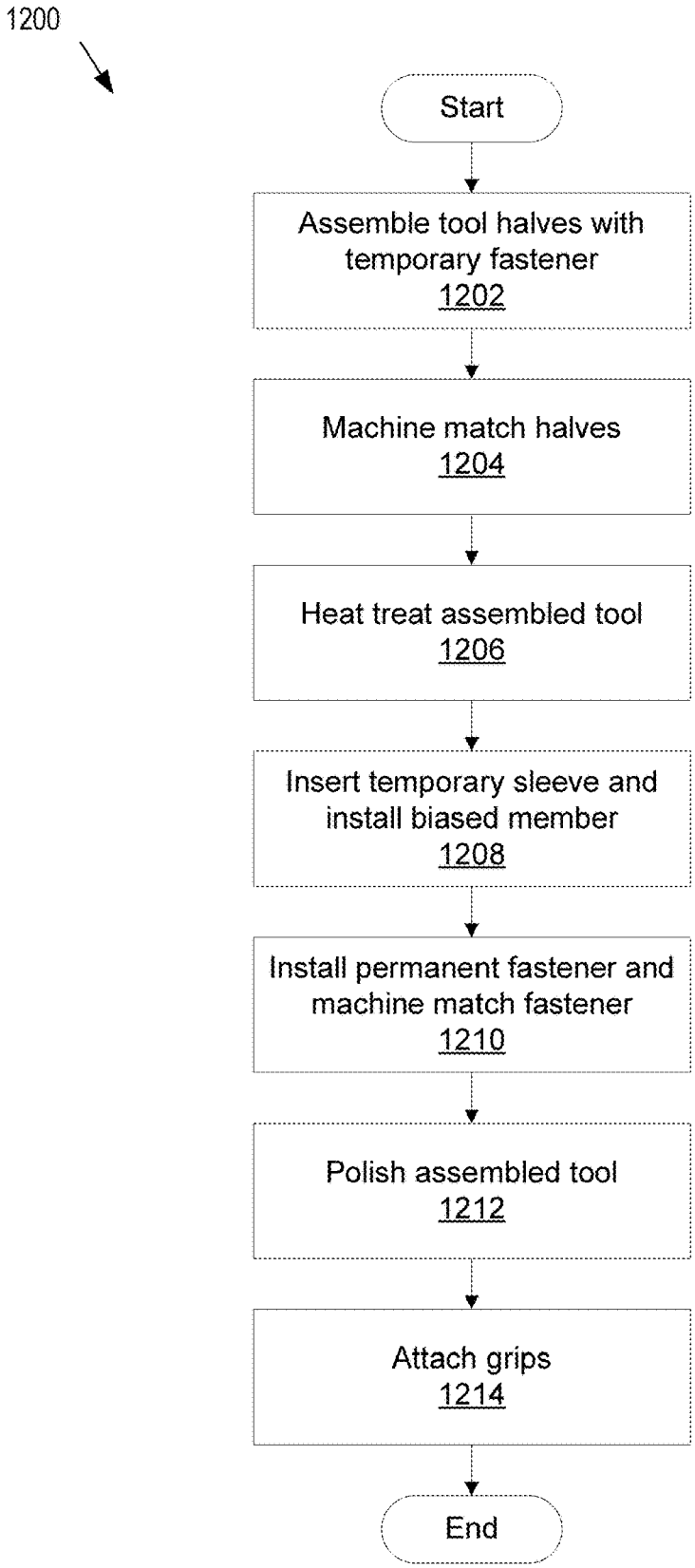
FIG. 12 is a schematic flow chart diagram illustrating one embodiment of a method for manufacturing a plier using a temporary sleeve and a permanent fastener in accordance with embodiments of the disclosure.

FIG. 12 is a schematic flow chart diagram illustrating one embodiment of a method for manufacturing a plier using a temporary sleeve and a permanent fastener in accordance with embodiments of the disclosure. In one embodiment, the method 1200 starts and the first tool half 804 and the second tool half 806 are assembled, at block 1202. A temporary fastener, as described above with reference to FIG. 7 may be utilized.

At block 1204, the first tool half 804 and the second tool half 806 are machined (i.e., ground) to precisely join the first tool half 804 and the second tool half 806. At block 1206, the first tool half 804 and the second tool half 806 are heat treated or hardened by any one of various hardening processes including, but not limited to, forging. At block 1208, a temporary sleeve is inserted into an opening in either the first tool half or the second tool half to assist in the installation of the biased member. The temporary sleeve engages an end of the biased member and aligns the end of the biased member with the opening in the first or second tool halves.

At block 1210, the temporary fastener is removed and the biased member is positioned between the first tool half and the second tool half, if not previously positioned. Stated differently, the biased member may be positioned in the housing before the hardening or heat treating process. The permanent fastener is inserted into the first tool half so that the permanent fastener passes through the opening of the first tool half, the biased member, and the opening of the second tool half. The permanent fastener, in one embodiment, is then deformed. In the example where the permanent fastener is a rivet, the non-flanged end is deformed to conform with a chamfered or beveled opening of the second tool half.

At block 1212, the deformed head (depicted by the dashed line of FIG. 6) is then machined, or ground to match the surface of the second tool half, and a final polishing of the tool may be performed. At block 1214, grips may be attached, at which point the method 1200 ends.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of manufacturing a plier, the method comprising:

providing a first tool half having a first jaw;

providing a second tool half having a second jaw;

machine matching the first tool half to the second tool half;

inserting a temporary fastener through openings in the first tool half and the second tool half, the temporary fastener configured to couple the first tool half to the second tool half;

heat treating the first tool half and the second tool half; and subsequent to the heat treating, removing the temporary fastener and inserting a permanent fastener.

2. The method of manufacturing a plier of claim 1, further comprising deforming an end of the permanent fastener to couple the first tool half to the second tool half.

3. The method of manufacturing a plier of claim 2, further comprising grinding smooth the deformed end of the permanent fastener.

4. The method of manufacturing a plier of claim 3, further comprising polishing the coupled first tool half and second tool half.

5. The method of manufacturing a plier of claim 4, further comprising attaching grips to each of the first tool half and the second tool half.

6. The method of manufacturing a plier of claim 5, where the attaching the grips to each of the first tool half and the second tool half further comprises coagulating a polymer coating onto the first and second tool halves.

7. The method of manufacturing a plier of claim 1, further comprising not hardening the permanent fastener by heat treatment.

8. A method of manufacturing a tool, the method comprising:

providing a first tool half having a first jaw;

providing a second tool half having a second jaw;

inserting a temporary sleeve through an opening in the first tool half, the temporary sleeve having an opening configured to receive an end of a biased member that extends axially;

aligning the end of the biased member with the opening in the first tool half;

disposing the biased member within a cavity formed by the first tool half and the second tool half; and removing the temporary sleeve.

9. The method of manufacturing a tool of claim 8, where the end of the biased member comprises a first end, and where the method further comprising inserting a second end of the biased member that extends axially into an opening in the second tool half prior to receiving the first end into the temporary sleeve.

10. The method of manufacturing a tool of claim 9, further comprising coupling the first tool half with the second tool half with a permanent fastener.

11. The method of manufacturing a tool of claim 10, further comprising deforming an end of the permanent fastener to secure the first tool half to the second tool half.

12. The method of manufacturing a tool of claim 11, further comprising grinding smooth the deformed end of the permanent fastener.

13. The method of manufacturing a tool of claim 9, further comprising heat treating the first tool half and the second tool half.

14. Pliers prepared by a process comprising the steps of:

providing a first tool half having a first jaw;

providing a second tool half having a second jaw;

inserting a temporary sleeve through an opening in the first tool half, the temporary sleeve having an opening configured to receive an end of a biased member that extends axially;

aligning the end of the biased member with the opening in the first tool half;

disposing the biased member within a cavity formed by the first tool half and the second tool half; and removing the temporary sleeve.

15. The pliers of claim 14, where the end of the biased member comprises a first end, and where the steps further comprise inserting a second end of the biased member that extends axially into an opening in the second tool half prior to receiving the first end into the temporary sleeve.

16. The pliers of claim 15, where the steps further comprise coupling the first tool half with the second tool half with a permanent fastener.

17. The pliers of claim 16, where the steps further comprise deforming an end of the permanent fastener to secure the first tool half to the second tool half.

18. The pliers of claim 17, where the steps further comprise grinding smooth the deformed end of the permanent fastener.

19. The pliers of claim 15 wherein the biased member biases the first tool half with respect to the second tool half by applying a biasing force on the opening in the first tool half and the opening in the second tool half.

20. The pliers of claim 14, where the steps further comprise heat treating the first tool half and the second tool half.

* * * * *